US011145285B2

(12) United States Patent
Roy et al.

(10) Patent No.: US 11,145,285 B2
(45) Date of Patent: Oct. 12, 2021

(54) EDITING OF MIDI FILES

(71) Applicant: Spotify AB, Stockholm (SE)

(72) Inventors: Pierre Roy, Paris (FR); François Pachet, Paris (FR)

(73) Assignee: Spotify AB, Stockholm (SE)

( * ) Notice: Subject to any disclaimer, the term of this patent is extended or adjusted under 35 U.S.C. 154(b) by 0 days.

(21) Appl. No.: 16/805,385

(22) Filed: Feb. 28, 2020

(65) Prior Publication Data

US 2020/0286455 A1 Sep. 10, 2020

(30) Foreign Application Priority Data

Mar. 4, 2019 (EP) ..... 19160593

(51) Int. Cl.
*G10H 1/00* (2006.01)

(52) U.S. Cl.
CPC ..... *G10H 1/0025* (2013.01); *G10H 1/0066* (2013.01); *G10H 2220/116* (2013.01); *G10H 2220/126* (2013.01); *G10H 2240/021* (2013.01)

(58) Field of Classification Search
CPC ..... G10H 1/0025; G10H 1/0066; G10H 2220/116; G10H 2220/126; G10H 2240/021
See application file for complete search history.

(56) References Cited

U.S. PATENT DOCUMENTS

| | | | |
|---|---|---|---|
| 5,952,598 | A | 9/1999 | Goede |
| 9,443,501 | B1 | 9/2016 | Thorsten |
| 2006/0031063 | A1 | 2/2006 | Tadahiko |
| 2014/0354434 | A1 | 12/2014 | Lalonde |
| 2018/0076913 | A1 | 3/2018 | Kiely et al. |

FOREIGN PATENT DOCUMENTS

EP 0484046 A2 * 5/1992 ..... G10H 1/00

OTHER PUBLICATIONS

Steinberg, Cubase 5 Operation Manual, 2017, pp. 46, 334-335, 348 (Year: 2017).*

(Continued)

*Primary Examiner* — Fan S Tsang
*Assistant Examiner* — David Siegel
(74) *Attorney, Agent, or Firm* — Morgan, Lewis & Bockius LLP

(57) ABSTRACT

The present disclosure relates to a method of editing an audio stream (S) having at least one tone (T1) extending over time in said stream. The method comprises cutting the stream at a first time point of the stream, producing a first cut (A) having a left cutting end ($A_L$) and a right cutting end ($A_R$); allocating a respective memory cell to each of the cutting ends; in each of the memory cells, storing information about the tone; and, for one of the cutting ends, concatenating the cutting end with a further stream cutting end which also has an allocated memory cell with information stored therein about any tones extending to said further cutting end. The concatenating comprises using the information stored in the memory cells for adjusting any of the tones extending to the cutting ends.

8 Claims, 4 Drawing Sheets

(56) References Cited

OTHER PUBLICATIONS

Anonymous, "Melodyne editor user manual," User Manual, vol. 29, No. 9, Jan. 14, 2015, XP055554042, ISSN: 0164-6338, Part 1, 67 pgs.
Anonymous, "Melodyne editor user manual," User Manual, vol. 29, No. 9, Jan. 14, 2015, XP055554042, ISSN: 0164-6338, Part 2, 72 pgs.
Anonymous, "Melodyne editor user manual," User Manual, vol. 29, No. 9, Jan. 14, 2015, XP055554042, ISSN: 0164-6338, Part 3, 73 pgs.
Anonymous, "Melodyne editor user manual," User Manual, vol. 29, No. 9, Jan. 14, 2015, XP055554042, ISSN: 0164-6338, Part 4, 10 pgs.
Spotify AB, Extended European Search Report, EP19160593.0, dated Sep. 12, 2019, 8 pgs.

* cited by examiner

EDITING OF MIDI FILES

RELATED APPLICATIONS

This application claims priority to European Patent Application No. 19160593, filed Mar. 4, 2019, which is hereby incorporated by reference in its entirety.

TECHNICAL FIELD

The present disclosure relates to a method and an editor for editing an audio file.

BACKGROUND

Music performance can be represented in various ways, depending on the context of use: printed notation, such as scores or lead sheets, audio signals, or performance acquisition data, such as piano-rolls or Musical Instrument Digital Interface (MIDI) files. Each of these representations captures partial information about the music that is useful in certain contexts, with its own limitations. Printed notation offers information about the musical meaning of a piece, with explicit note names and chord labels (in, e.g., lead sheets), and precise metrical and structural information, but it tells little about the sound. Audio recordings render timbre and expression accurately, but provide no information about the score. Symbolic representations of musical performance, such as MIDI, provide precise timings and are therefore well adapted to edit operations, either by humans or by software.

A need for editing musical performance data may arise from two situations. First, musicians often need to edit performance data when producing a new piece of music. For instance, a jazz pianist may play an improvised version of a song, but this improvisation should be edited to accommodate for a posteriori changes in the structure of the song. The second need comes from the rise of Artificial Intelligence (AI)-based automatic music generation tools. These tools may usually work by analysing existing human performance data to produce new ones. Whatever the algorithm used for learning and generating music, these tools call for editing means that preserve as far as possible the expressiveness of original sources.

However, editing music performance data raises special issues related to the ambiguous nature of musical objects. A first source of ambiguity may be that musicians produce many temporal deviations from the metrical frame. These deviations may be intentional or subconscious, but they may play an important part in conveying the groove or feeling of a performance. Relations between musical elements are also usually implicit, creating even more ambiguity. A note is in relation with the surrounding notes in many possible ways, e.g. it can be part of a melodic pattern, and it can also play a harmonic role with other simultaneous notes, or be a pedal-tone. All these aspects, although not explicitly represented, may play an essential role that should preferably be preserved, as much as possible, when editing such musical sequences.

The MIDI file format has been successful in the instrument industry and in music research and MIDI editors are known, for instance in Digital Audio Workstations. However, the problem of editing MIDI with semantic-preserving operations has not previously been addressed. Attempts to provide semantically-preserving edit operations have been made on the audio domain (e.g. by Whittaker, S., and Amento, B. "Semantic speech editing", in Proceedings of the SIGCHI conference on Human factors in computing systems (2004), ACM, pp. 527-534) but these attempts are not transferrable to music performance data, as explained below.

In human-computer interactions, cut, copy and paste are the so called holy trinity of data manipulation. These three commands have proved so useful that they are now incorporated in almost every software, such as word processing, programming environments, graphics creation, photography, audio signal, or movie editing tools. Recently, they have been extended to run across devices, enabling moving text or media from, for instance, a smartphone to a computer. These operations are simple and have clear, unambiguous semantics: cut, for instance, consists in selecting some data, say a word in a text, removing it from the text, and saving it to a clipboard for later use.

Each type of data to be edited raises its own editing issues that have led to the development of specific editing techniques. For instance, editing of audio signals usually requires cross fades to prevent clicks. Similarly, in movie editing, fade-in and fade-out are used to prevent harsh transitions in the image flow. Edge detection algorithms were developed to simplify object selection in image editing. The case of MIDI data is no exception. Every note in a musical work is related to the preceding, succeeding, and simultaneous notes in the piece. Moreover, every note is related to the metrical structure of the music.

SUMMARY

It is an objective of the present disclosure to address the issue of editing musical performance data represented as an editable audio file, e.g. MIDI, while preserving as much as possible its semantic.

According to an aspect of the present disclosure, there is provided a method for editing an audio file. The audio file comprises information about a time stream having a plurality of tones extending over time in said stream. The method comprises cutting the stream at a first time point of the stream, producing a first cut having a first left cutting end and a first right cutting end. The method also comprises allocating a respective memory cell to each of the first cutting ends. The method also comprises, in each of the memory cells, storing information about those of the plurality of tones which extend to the cutting end to which the memory cell is allocated. The method also comprises, for each of at least one of the first cutting ends, concatenating the cutting end with a further stream cutting end which has an allocated memory cell with information stored therein about those tones which extend to said further cutting end. The concatenating comprises using the information stored in the memory cells of the first cutting end and the further cutting end for adjusting any of the tones extending to the first cutting end and the further cutting end.

The method aspect may e.g. be performed by an audio editor running on a dedicated or general purpose computer.

According to another aspect of the present disclosure, there is provided a computer program product comprising computer-executable components for causing an audio editor to perform the method of any preceding claim when the computer-executable components are run on processing circuitry comprised in the audio editor.

According to another aspect of the present disclosure, there is provided an audio editor configured for editing an audio file. The audio file comprises information about a time stream having a plurality of tones extending over time in said stream. The audio editor comprises processing circuitry, and data storage storing instructions executable by said processing circuitry whereby said audio editor is operative to cut the stream at a first time point of the stream, producing a first cut having a first left cutting end and a first right cutting end. The audio editor is also operative to allocate a respective memory cell of the data storage to each of the first cutting ends. The audio editor is also operative to, in each of the memory cells, store information about those of the plurality of tones which extend to the cutting end to which the memory cell is allocated. The audio editor is also operative to, for each of at least one of the first cutting ends, concatenating the cutting end with a further stream cutting end which has an allocated memory cell of the data storage with information stored therein about those tones which extend to the further cutting end. The concatenating comprises using the information stored in the memory cells of the first cutting end and the further cutting end for adjusting any of the tones extending to the first cutting end and the further cutting end.

Further, some embodiments of the present disclosure provide a system for editing an audio file, the audio file comprising information about a time stream having a plurality of tones extending over time in said time stream, the system comprising: one or more processors; and memory storing one or more programs, the one or more programs including instructions, which, when executed by the one or more processors, cause the one or more processors to perform any of the methods described herein.

Further, some embodiments of the present disclosure provide a non-transitory computer-readable storage medium storing one or more programs for editing an audio file, the audio file comprising information about a time stream having a plurality of tones extending over time in said time stream, wherein the one or more programs include instructions, which, when executed by a system with one or more processors, cause the system to perform any of the methods described herein.

It is to be noted that any feature of any of the aspects may be applied to any other aspect, wherever appropriate. Likewise, any advantage of any of the aspects may apply to any of the other aspects. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

Embodiments will be described, by way of example, with reference to the accompanying drawings, in which.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

Herein, the problem of editing non-quantized, metrical musical sequences represented as e.g. MIDI files is discussed. A number of problems caused by the use of naive edition operations applied to performance data are presented using a motivating example of FIGS. 1*a* and 1*b*. A way of handling these problems is in accordance with the present disclosure to allocate a respective memory cell to each loose end of an audio stream which is formed by cutting said audio stream during editing thereof. A memory cell, as presented herein can be regarded as a part of a data storage, e.g. of an audio editor, used for storing information relating to tones affected by the cutting. The information stored may typically relate to the properties (e.g. length/duration, pitch, velocity/loudness etc.) of the tones prior to the cutting. As used herein, the term memory cell is used to refer to a block of memory. In some embodiments, a memory cell has a predetermined size (e.g., in bits). Note that, as used herein, a memory cell does not necessarily refer to a memory device storing a single bit, but rather generally refers to a block that holds a plurality of bits. By means of the memory cells, and the information stored therein, an edited audio stream can be processed to remove the artefacts. Thus, the artefacts of FIG. 1*b* may be removed in accordance with the result of FIG. 1*c*.

Figure 1A:
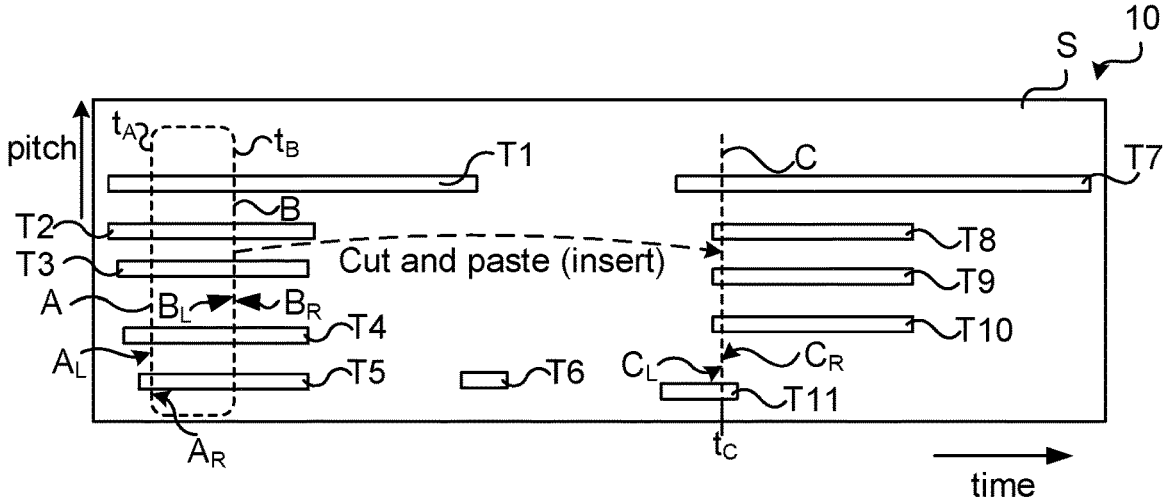
FIG. 1*a* illustrates a time stream of an audio file, having a plurality of tones at different pitch and extending over different time durations, a time section of said stream being cut out from one part of the stream and inserted at another part of the stream, in accordance with embodiments of the present disclosure.

FIG. 1*a* illustrates an time stream S of a piano roll by Brahms in an audio file 10. Herein, MIDI is used as an example audio file format. In the figure, the x-axis is time and the y-axis is pitch, and a plurality of tones T, here eleven tones T1-T11, are shown in accordance with their respective time durations and pitch.

An edit operation is illustrated, in which two beats of a measure, between a first time point $t_A$ and a second time point $t_B$ (illustrated by dashed lines in the figure) are cut out and inserted in a later measure of the stream, in a cut a third time point $t_C$. To perform the edit operation, three cuts A, B and C are made at the first, second and third time points $t_A$, $t_B$ and $t_C$, respectively. The first cut A produces a first left cutting end $A_L$ and a first right cutting end $A_R$. The second cut B produces a second left cutting end $B_L$ and a second right cutting end $B_R$. The third cut C produces a third left cutting end $C_L$ and a third right cutting end $C_R$.

Figure 1B:
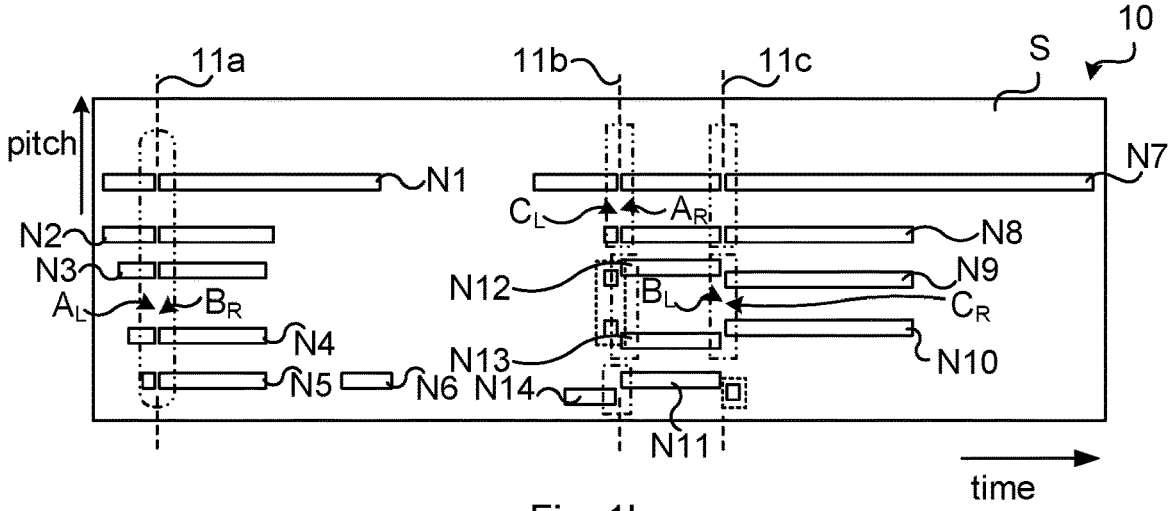
FIG. 1*b* illustrates the time stream of FIG. 1*a* after the time section has been inserted, showing some different types of artefacts initially caused by the cut out and insertion, which may be handled in accordance with embodiments of the present disclosure.

FIG. 1*b* shows the piano roll produced when the edit operation has been performed in a straightforward way, i.e., when considering the tones T as mere time intervals. Thus, the time section between the first and second time points $t_A$ and $t_B$ in FIG. 1*a* has been inserted between the third left and right cutting ends $C_L$ and $C_R$ to produce fourteen new (edited) tones N, N1-N14. Tones that are extending across any of the cuts A, B and/or C are segmented, leading to several musical inconsistencies (herein also called artefacts). For instance, long tones, such as the high tones N1 and N7, are split into several contiguous short notes. This alters the listening experience, as several attacks are heard, instead of a single one. Additionally, the tone velocities (a MIDI equivalent of loudness) are possibly changing at each new attack, which is quite unmusical. Another issue is that splitting notes with no consideration of the musical context may lead to creating excessively short note fragments, also called residuals. Fragments are disturbing, especially if their velocity is high, and are perceived as clicks in the audio signals. Also, a side effect of the edit operation may be that some notes are quantized (resulting in a sudden change of pitch when jumping from one tone to another, e.g. from N14 to N11, or N13 to N9). As a result, slight temporal deviations present in the original MIDI stream are lost in the process. Such temporal deviations may be important parts of the performance, as they convey the groove, or feeling of the piece, as interpreted by the musician.

In FIG. 1*b*, tone splits are marked by dash-dot-dot-dash lines, where long tones are split, creating superfluous attacks, fragments (too short tones) are marked by dotted lines, and undesirable quantization, where small temporal deviations in respect of the metrical structure are lost, are marked by dash-dot-dash lines. Additionally, surprising and undesired changes in velocity (loudness) may occur at the seams 11 (schematically indicated by dashed lines extending outside of the illustrated stream S).

In the stream S of FIG. 1*b*, the first left cutting end $A_L$ is joined with the second right cutting end $B_R$ in a first seam 11*a*, the third left cutting end $C_L$ is joined with the first right cutting end $A_R$ in a second seam 11*b*, and the second left cutting end $B_L$ is joined with the third right cutting end $C_R$ in a third seam 11*c*.

Figure 1C:
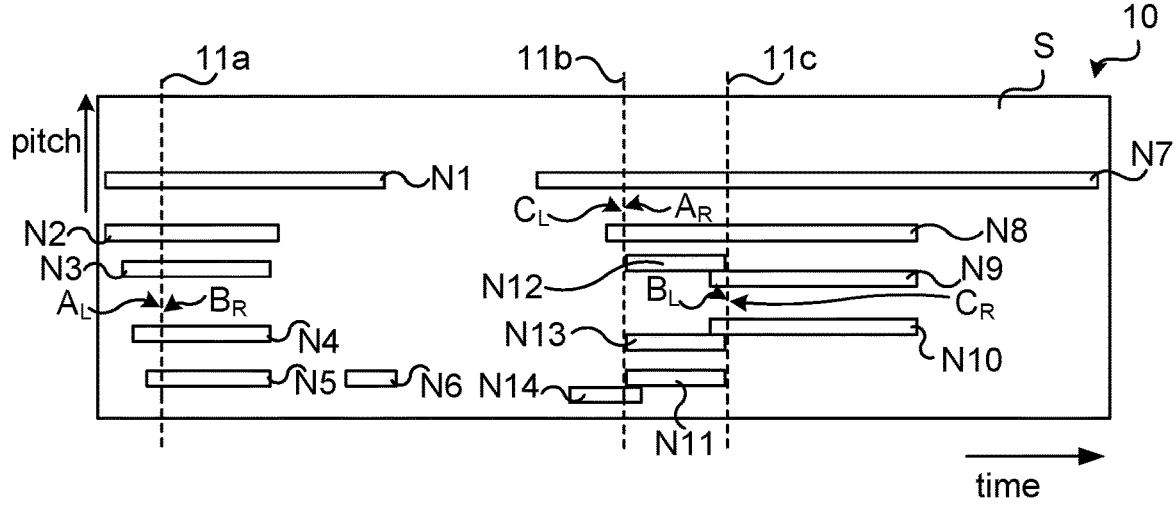
FIG. 1*c* illustrates the time stream of FIG. 1*b*, after processing to remove artefacts, in accordance with embodiments of the present disclosure.

FIG. 1*c* shows how the edited piano roll of FIG. 1*c* may be after processing to remove the artefacts, as enabled by embodiments of the present disclosure. Fragments, splits and quantization problems have been removed or reduced. For instance, all fragments marked in FIG. 1*b* have been deleted, all splits marked in FIG. 1*b* have been removed by fusing the tone across the seam 11, and quantization problems have been removed or reduced by extending some of the new tones across the seam, e.g. tones N9, N10 and N14, in order to recreate the tones to be similar as before the editing operation (in effect reconnecting the deleted fragments to the tones).

Cut, copy, and paste operations may be performed using two basic primitives: split and concatenate. The split primitive is used to separate an audio stream S (or MIDI file) at a specified temporal position, e.g. time point $t_A$, yielding two streams (see e.g. streams S1 and S2 of FIG. 3*b*): the first stream S1 contains the music played before the cut A and the second stream S2 contains the music played after the cut A. The concatenate operation takes two audio streams S1 and S2 as input and returns a single stream S by appending the second stream to the first one (see e.g. FIG. 3*c*). To cut out a section of an audio stream S, as in FIG. 1*a*, between a first time point $t_A$ and a second time point $t_B$, the following primitive operations are performed:

1. Cut sequence S at time point $t_B$, which returns streams S1 and S2.
2. Cut the second sequence S2 at time point $t_A$, which returns streams S3 and S4, S4 corresponding to the section between time points $t_A$ and $t_B$.
3. Store sequence S4 to a digital clipboard.
4. Return the concatenation of S3 and S2.

Similarly, to insert a stream, e.g. stored stream S4 (as above), in a stream S at time point $t_C$, one may:

1. Cut the stream S at time point $t_C$, producing two streams S1 (duration of S prior to $t_C$) and S2 (duration of S after $t_C$), not identical to S1 and S2 discussed above.
2. Return the concatenation of S1, S4, and S2, in this order.

Figure 2:
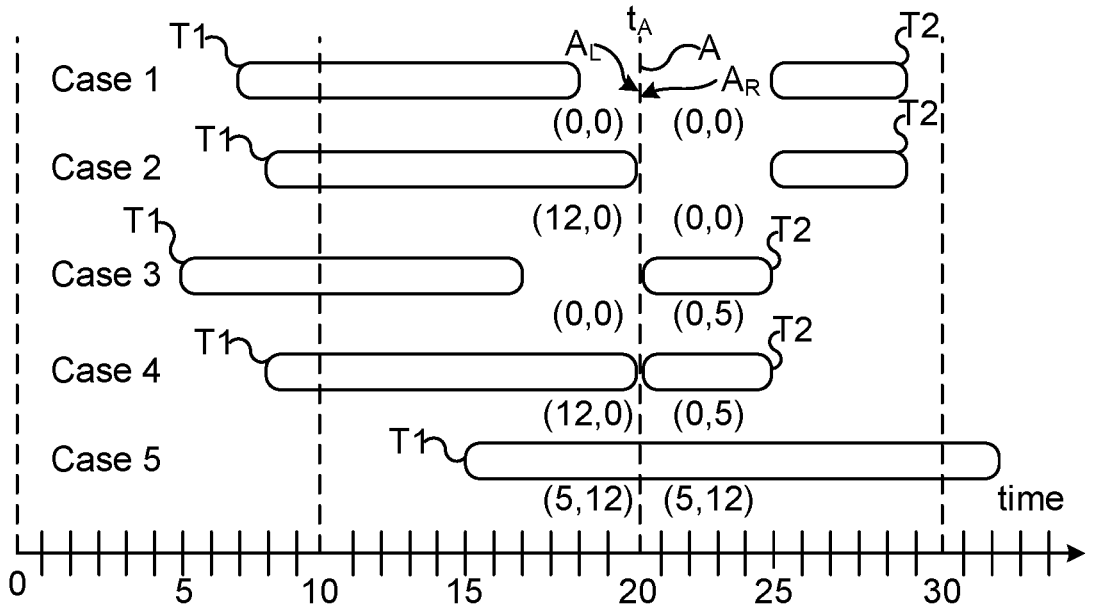
FIG. 2 illustrates information which can be stored in a memory cell of a cutting end regarding any tone extending to said cutting end, in accordance with embodiments of the present disclosure.

FIG. 2 illustrates five different cases for a cut A at a cutting time $t_A$. For each case, there is a left memory cell allocated to the left cutting end $A_L$ and a right memory cell allocated to the right cutting end $A_R$. Some information about tones T which may be stored in the respective left and right memory cells are schematically presented within parenthesis. In these cases, the information stored relates to the length/duration of the tones T extending in time to, and thus affected by, the cut A. However, other information about the tones T may additionally or alternatively be stored in the memory cells, e.g. information relating to pitch and/or velocity/loudness of the tones prior to cutting.

In the first case, none of the first and second tones T1 and T2 extend to the cut A, resulting in both left and right memory cells being empty, indicated as (0,0).

In the second case, the first tone T1 touches the left cutting end $A_L$, resulting in information about said first tone T1 being stored in the left memory cell as (12,0) indicating that the first tone extends 12 units of time to the left of the cut A but no time unit to the right of the cut A. None of the first and second tones T1 and T2 extends to the right cutting end $A_R$ (i.e. none of the tones extends to the cut A from the right of the cut), why the right memory cell is empty.

Conversely, in the third case, the second tone T2 touches the right cutting end $A_R$, resulting in information about said second tone T2 being stored in the right memory cell as (0,5) indicating that the second tone extends 5 units of time to the right of the cut A but no time unit to the left of the cut A. None of the first and second tones T1 and T2 extends to the left cutting end $A_L$ (i.e. none of the tones extends to the cut A from the left of the cut), why the left memory cell is empty.

In the fourth case, both of the first and second tones T1 and T2 touch respective cutting ends AL and AR (i.e. both tones ends at $t_A$, without overlapping in time). Thus, information about the first tone T1 is stored in the left memory cell as (12,0) indicating that the first tone extends 12 units of time to the left of the cut A but no time unit to the right of the cut A, and information about the second tone T2 is stored in the right memory cell as (0,5) indicating that the second tone extends 5 units of time to the right of the cut A but no time unit to the left of the cut A.

In the fifth case, a single (first) tone T1 is shown extending across the cutting time $t_A$ and thus being divided in two parts by the cut A. Thus, information about the first tone T1 is stored in the left memory cell as (5,12) indicating that the first tone extends 5 units of time to the left of the cut A and 12 time units to the right of the cut A, and information about the same first tone T1 is stored in the right memory cell, also as (5,12) indicating that the first tone extends 5 units of time to the left of the cut A and 12 time units to the right of the cut A.

As discussed herein, the information stored in the respective memory cells may be used for determining how to handle the tones extending to the cut A when concatenating either of the left and right cutting ends with another cutting end (of the same stream S or of another stream). In accordance with embodiments of the present disclosure, a tone extending to a cutting end can, after concatenating with another cutting end, be adjusted based on the information about the tone stored in the memory cell of the cutting end.

Examples of such adjusting includes:

- Removing a fragment of the tone, e.g. if the tone extending to the cutting edge after the cut has been made has a duration which is below a predetermined threshold or has a duration which is less than a predetermined percentage of the original tone (cf. the fragments marked in FIG. 1*b*).
- Extending a tone over the cutting ends. For instance, the information stored in the respective memory cells of the concatenated cutting ends may indicate that it is suitable that a tone extending to one of the cutting edges is extended across the cutting edges, i.e. extending to the other side of the cutting edge it extends to (cf. the tones N9, N10 and N14 in FIGS. 1*b* and 1*c*).
- Merging a tone extending to a first cutting end with a tone extending to the cutting with which it is concatenated, thus avoiding the splits and quantized situations discussed herein (cf. tones N1, N2, N3, N4, N5, N7 and N8 of FIGS. 1*b* and 1*c*).

Regarding removal of fragments, in some embodiments, two different duration thresholds may be used, e.g. an upper threshold and a lower threshold. In that case, if the duration of a part of a tone T which is created after making a cut A is below the lower threshold, the part is regarded as a fragment and removed from the audio stream, regardless of its percentage of the original tone duration. On the other hand, if the duration of the part of the tone T which is created after making a cut A is above the upper threshold, the part is kept in the audio stream, regardless of its percentage of the original tone duration. However, if the duration of the part of the tone T which is created after making a cut A is between the upper and lower duration thresholds, whether it is kept or removed may depend on its percentage of the original tone duration, e.g. whether it is above or below a percentage threshold. This may be used e.g. to avoid removal of long tone parts just because they are below a percentage threshold.

Figure 3:
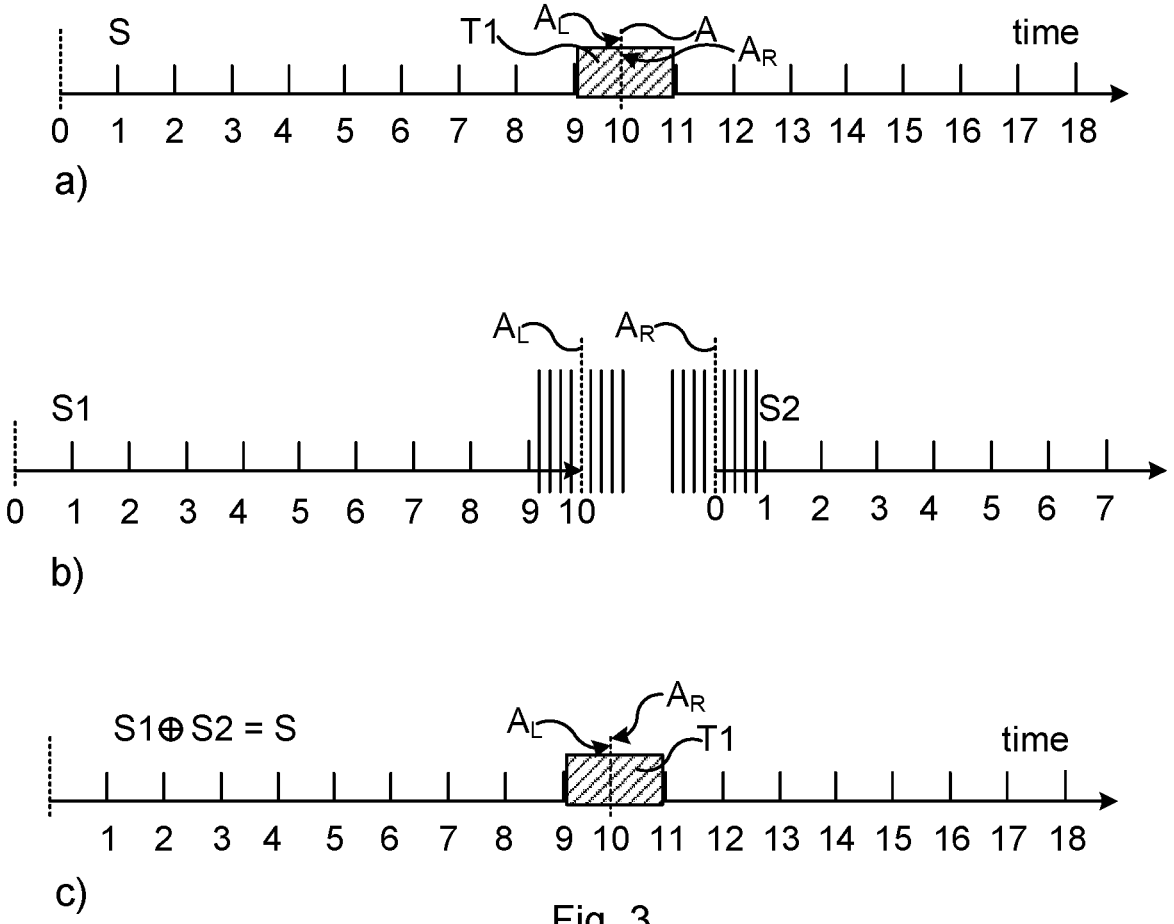
FIG. 3 illustrates a) a stream being cut in the middle of a tone, b) producing two separate streams where the tone fragments are removed, and c) reconnecting (concatenating) the two streams to produce the original stream and recreating the tone, in accordance with embodiments of the present disclosure.

FIG. 3 illustrates how the allocated memory cells enables to avoid fragments while not loosing information about cut tones.

In FIG. 3*a*, a cut A is made in stream S, dividing tone T1. Since tone T1 extends across the cut A (cf. case five of FIG. 2), information about the tone T1 is stored both in the memory cell allocated to the left cutting end $A_L$ and in the memory cell allocated to the right cutting end $A_R$.

In FIG. 3*b*, the cut A has resulted in stream S having been divided into a first stream S1, constituting the part of stream S to the left of the cut A, and a second stream S2, constituting the part of stream S to the right of the cut A. It is determined that the part of the divided tone T1 in either of the first and second streams S1 and S2 is so short as to be regarded as a fragment and it is removed from the streams S1 and S2, respectively. That the tone is so short that it is regarded as a fragment may be decided based on it being below a duration threshold or based on it being less than a predetermined percentage of the original tone T1. However, thanks to the information about the original tone T1 being stored in both the left and right memory cells, the tone T1 as it was before divided by the cut A is remembered in both the first and second streams S1 and S2 (as illustrated by the hatched boxes.

In FIG. 3*c*, the first and second streams are re-joined by concatenating the left cutting end $A_L$ and the right cutting end $A_R$. By virtue of the information stored in the respective memory cells, the previous existence of the tone T1 is known and recreation of the tone is enabled. Thus, the original stream S can be recreated, which would not have been possible without the use of the memory cells.

Figure 4A:
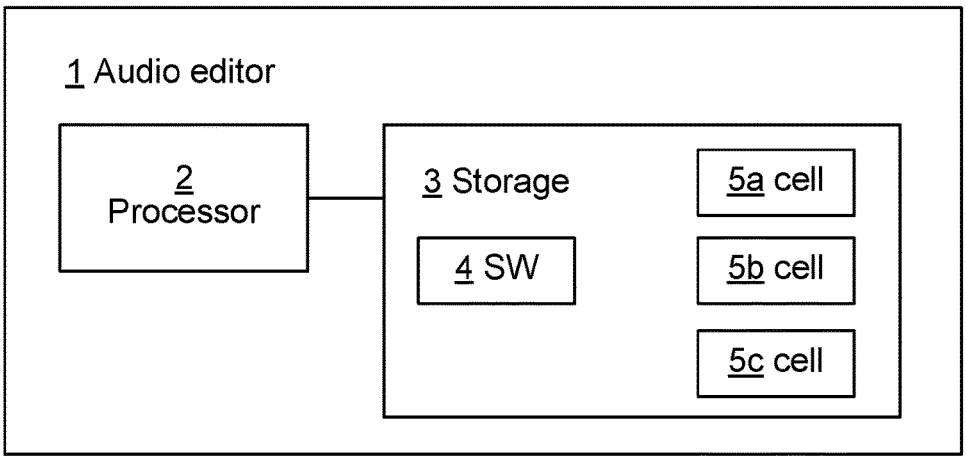
FIG. 4*a* is a schematic block diagram of an audio editor, in accordance with embodiments of the present disclosure.

FIG. 4*a* illustrates an embodiment of an audio editor 1, e.g. implemented in a dedicated or general purpose computer by means of software (SW). The audio editor comprises processing circuitry 2 e.g. a central processing unit (CPU). The processing circuitry 2 may comprise one or a plurality of processing units in the form of microprocessor (s), such as Digital Signal Processor (DSP). However, other suitable devices with computing capabilities could be comprised in the processing circuitry 2, e.g. an application specific integrated circuit (ASIC), a field programmable gate array (FPGA) or a complex programmable logic device (CPLD). The processing circuitry 2 is configured to run one or several computer program(s) or software (SW) 4 stored in a data storage 3 of one or several storage unit(s) e.g. a memory. The storage unit is regarded as a computer readable means as discussed herein and may e.g. be in the form of a Random Access Memory (RAM), a Flash memory or other solid state memory, or a hard disk, or be a combination thereof. The processing circuitry 2 may also be configured to store data in the storage 3, as needed. The storage 3 also comprises a plurality of the memory cells 5 discussed herein.

Figure 4B:
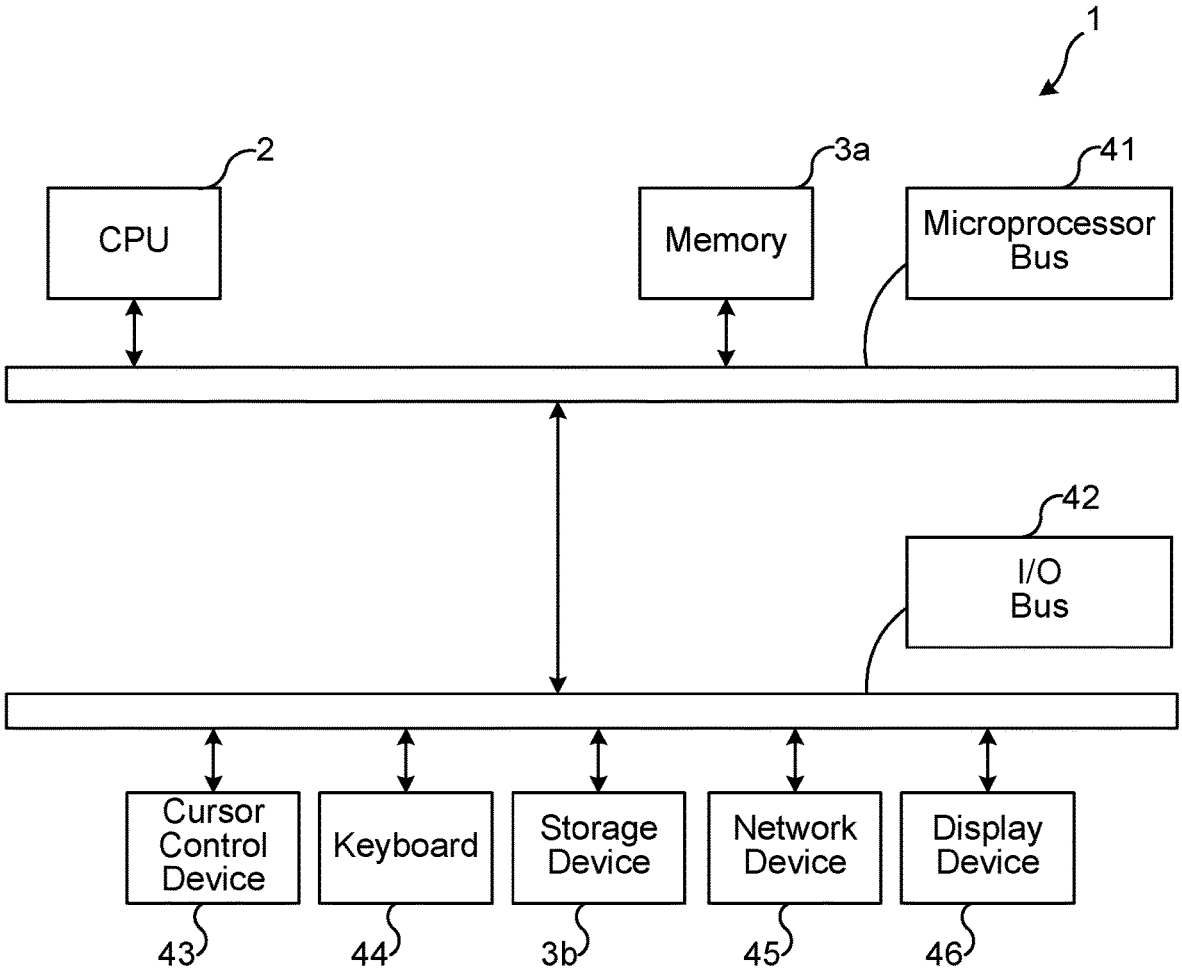
FIG. 4*b* is a schematic block diagram of an audio editor, illustrating more specific examples in accordance with embodiments of the present disclosure.

FIG. 4*b* illustrates some more specific example embodiments of the audio editor 1. The audio editor can comprise a microprocessor bus 41 and an input-output (I/O) bus 42. The processing circuitry 2, here in the form of a CPU, is connected to the microprocessor bus 41 and communicates with the work memory 3*a* part of the data storage 3, e.g. comprising a RAM, via the microprocessor bus. To the I/O bus 42 are connected circuitry arranged to interact with the surroundings audio editor, e.g. with a user of the audio editor or with another computing device e.g. a server or external storage device. Thus, the I/O bus may connect e.g. a cursor control device 43, such as a mouse, joystick, touch pad or other touch-based control device; a keyboard 44; a long-term data storage part 3*b* of the data storage 3, e.g. comprising a hard disk drive (HDD) or solid-state drive (SDD); a network interface device 45, such as a wired or wireless communication interface e.g. for connecting with another computing device over the internet or locally; and/or a display device 46, such as comprising a display screen to be viewed by the user.

Figure 5:
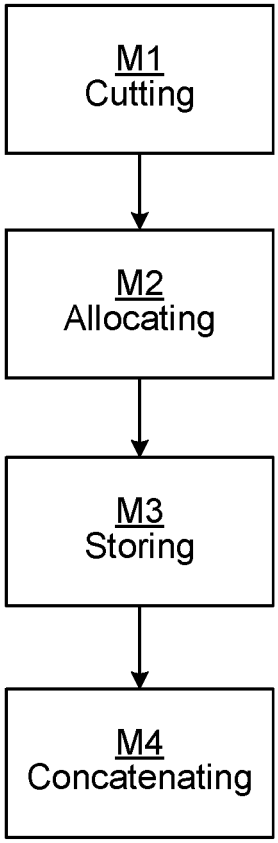
FIG. 5 is a schematic flow chart of a method in accordance with embodiments of the present disclosure.

FIG. 5 illustrates some embodiments of the method of the disclosure. The method is for editing an audio file 10. The audio file comprises information about a time stream S having a plurality of tones T extending over time in said stream. The method comprises cutting M1 the stream S at a first time point to of the stream, producing a first cut A having a first left cutting end $A_L$ and a first right cutting end $A_R$. The method also comprises allocating M2 a respective memory cell 5 to each of the first cutting ends $A_L$ and $A_R$. The method also comprises, in each of the memory cells 5, storing M3 information about those of the plurality of tones T which extend to the cutting end $A_L$ or $A_R$ to which the memory cell is allocated. The method also comprises, for each of at least one of the first cutting ends $A_L$ and/or $A_R$, concatenating M4 the cutting end with a further stream cutting end $B_R$ or $C_R$, or $B_L$ or $C_L$ which has an allocated memory cell 5 with information stored therein about those tones T which extend to said further cutting end. The concatenating M4 comprises using the information stored in the memory cells 5 of the first cutting end $A_L$ or $A_R$ and the further cutting end $B_R$ or $C_R$, or $B_L$ or $C_L$ for adjusting any of the tones T extending to the first cutting end and the further cutting end.

In some embodiments of the present disclosure, the audio file 10 is in accordance with a MIDI file format, which is a well-known editable audio format.

In some embodiments of the present disclosure, the further cutting end $B_R$ or $C_R$, or $B_L$ or $C_L$ is from the same time stream S as the first cutting end $A_L$ or $A_R$, e.g. when cutting and pasting within the same stream S. In some embodiments, the further cutting end is a second left or right cutting end $B_L$ or $B_R$, or $C_L$ or $C_R$ of a second cut B or C produced by cutting the stream S at a second time point $t_B$ or $t_C$ in the stream. In some embodiments, the at least one of the first cutting ends is the first left cutting edge $A_L$ and the further cutting end is the second right cutting edge $B_R$ or $C_R$.

In some other embodiments of the present disclosure, the further cutting end $B_R$ or $C_R$, or $B_L$ or $C_L$ is from another time stream than the time stream S of the first cutting end $A_L$ or $A_R$, e.g. when cutting from one stream and inserting in another stream.

In some embodiments of the present disclosure, the adjusting comprises any of: removing a fragment of a tone T; extending a tone over the cutting ends $A_L$ or $A_R$; and $B_R$ or $C_R$, or $B_L$ or $C_L$; and merging a tone extending to the first cutting end $A_L$ or $A_R$ with a tone extending to the further cutting end $B_R$ or $C_R$, or $B_L$ or $C_L$ (e.g. handling splits and quantized issues).

Embodiments of the present disclosure may be conveniently implemented using one or more conventional general purpose or specialized digital computer, computing device, machine, or microprocessor, including one or more processors, memory and/or computer readable storage media programmed according to the teachings of the present disclosure. Appropriate software coding can readily be prepared by skilled programmers based on the teachings of the present disclosure, as will be apparent to those skilled in the software art.

In some embodiments, the present disclosure provides a computer program product 3 which is a non-transitory storage medium or computer readable medium (media) having instructions 4 stored thereon/in, in the form of computer-executable components or software (SW), which can be used to program a computer 1 to perform any of the methods/processes of the present disclosure. Examples of the storage medium can include, but is not limited to, any type of disk including floppy disks, optical discs, DVD, CD-ROMs, microdrive, and magneto-optical disks, ROMs, RAMs, EPROMs, EEPROMs, DRAMs, VRAMs, flash memory devices, magnetic or optical cards, nanosystems (including molecular memory ICs), or any type of media or device suitable for storing instructions and/or data.

According to a more general aspect of the present disclosure, there is provided a method of editing an audio stream (S) having at least one tone T extending over time in said stream. The method comprises cutting M1 the stream at a first time point to of the stream, producing a first cut A having a left cutting end $A_L$ and a right cutting end $A_R$. The method also comprises allocating M2 a respective memory cell 5 to each of the cutting ends. The method also comprises, in each of the memory cells, storing M3 information about the tone T. The method also comprises, for one of the cutting ends $A_L$ or $A_R$, concatenating M4 the cutting end with a further cutting end $B_R$ or $C_R$, or $B_L$ or $C_L$ which also has an allocated memory cell 5 with information stored therein about any tones T extending to said further cutting end. The concatenating M4 comprises using the information stored in the memory cells 5 for adjusting any of the tones T extending to the cutting ends $A_L$ or $A_R$, and $B_R$ or $C_R$ or $B_L$ or $C_L$.

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. A method of editing an audio file, the audio file comprising information about a time stream having a plurality of tones extending over time in said time stream, the method comprising:

cutting the time stream at a first time point of the time stream, producing a first cut having a plurality of first cutting ends, including a first left cutting end and a first right cutting end;

allocating a respective memory cell of a plurality of memory cells to each of the first cutting ends;

for each of the first cutting ends, storing, in the allocated respective memory cell, information for each tone of the plurality of tones which extend to the corresponding first cutting end; and for each of at least one of the first cutting ends, concatenating the respective first cutting end with a further cutting end based on information stored about tones which extend to said further cutting end;

wherein the concatenating comprises using the information stored in the memory cells of the respective first cutting end and the information about the tones which extend to said further cutting end for adjusting any of the tones extending to the respective first cutting end and the further cutting end.

2. The method of claim 1, wherein the audio file is in accordance with a Musical Instrument Digital Interface, MIDI, file format.

3. The method of claim 1, wherein the further cutting end is from the same time stream as the respective first cutting end.

4. The method of claim 3, wherein the further cutting end is a second left or right cutting end of a second cut produced by cutting the stream at a second time point in the stream.

5. The method of claim 4, wherein the at least one of the first cutting ends is the first left cutting end and the further cutting end is the second right cutting edge end.

6. The method of claim 1, wherein the adjusting comprises one or more operations selected from the group consisting of:

removing a fragment of a tone;

extending a tone over the respective end or said further cutting end; and merging a tone extending to the respective first cutting end with a tone extending to the further cutting end.

7. A system for editing an audio file, the audio file comprising information about a time stream having a plurality of tones extending over time in said time stream, the system comprising:

one or more processors; and memory storing one or more programs, the one or more programs including instructions, which, when executed by the one or more processors, cause the one or more processors to perform a set of operations, including:

cutting the time stream at a first time point of the time stream, producing a first cut having a plurality of first cutting ends, including a first left cutting end and a first right cutting end;

allocating a respective memory cell of a plurality of memory cells to each of the first cutting ends;

for each of the first cutting ends, storing, in the allocated respective memory cell, information for each tone of the plurality of tones which extend to the corresponding first cutting end; and for each of at least one of the first cutting ends, concatenating the respective first cutting end with a further cutting end based on information stored about tones which extend to said further cutting end;

wherein the concatenating comprises using the information stored in the memory cells of the respective first cutting end and the information about the tones which extend to said further cutting end for adjusting any of the tones extending to the respective first cutting end and the further cutting end.

8. A non-transitory computer-readable storage medium storing one or more programs for editing an audio file, the audio file comprising information about a time stream having a plurality of tones extending over time in said time stream, wherein the one or more programs include instructions, which, when executed by a system with one or more processors, cause the system to perform a set of operations, including:

cutting the time stream at a first time point of the time stream, producing a first cut having a plurality of first cutting ends, including a first left cutting end and a first right cutting end;

allocating a respective memory cell of a plurality of memory cells to each of the first cutting ends;

for each of the first cutting ends, storing, in the allocated respective memory cell, information for each tone of the plurality of tones which extend to the corresponding first cutting end; and for each of at least one of the first cutting ends, concatenating the respective first cutting end with a further cutting end based on information stored about tones which extend to said further cutting end;

wherein the concatenating comprises using the information stored in the memory cells of the respective first cutting end and the information about the tones which extend to said further cutting end for adjusting any of the tones extending to the respective first cutting end and the further cutting end.

* * * * *